US005421063A

United States Patent [19]

Grass

[11] Patent Number: 5,421,063

[45] Date of Patent: Jun. 6, 1995

[54] SINGLE ARTICULATION HINGE

[75] Inventor: Alfred Grass, Hochst, Austria

[73] Assignee: Grass AG, Hochst/Vlbg., Austria

[21] Appl. No.: 147,644

[22] Filed: Nov. 4, 1993

Related U.S. Application Data

[63] Continuation of Ser. No. 755,665, Sep. 6, 1991, abandoned.

[51] Int. Cl.[6] ..... E05F 1/08

[52] U.S. Cl. ..... 16/307; 16/277

[58] Field of Search ..... 16/335, 336, 380, 307, 16/295, 296, 332, 277

[56] References Cited

U.S. PATENT DOCUMENTS

| | | | |
|---|---|---|---|
| 1,728,433 | 9/1929 | Mohun | 16/277 |
| 2,538,372 | 1/1951 | Light | 16/380 |
| 3,418,683 | 12/1968 | Stone et al. | 16/335 |
| 3,577,840 | 5/1971 | Buberniak | 16/332 |
| 3,728,757 | 4/1973 | Lloyd | 16/332 |
| 3,911,529 | 10/1975 | Pringle | 16/335 |
| 4,332,055 | 6/1982 | Rudnick et al. | 16/335 |
| 4,675,941 | 6/1987 | Grass | 16/295 |

FOREIGN PATENT DOCUMENTS

| | | | |
|---|---|---|---|
| 2265953 | 10/1975 | France | 16/335 |
| 3120065 | 12/1982 | Germany | 16/277 |
| 2199888 | 7/1988 | United Kingdom | 16/277 |

*Primary Examiner*—P. Austin Bradley
*Assistant Examiner*—Chuck Y. Mah

[57] ABSTRACT

A single-articulation door hinge with a pressure closing device is associated with a hinge arm mounted in a hinge barrel on a hinge pin. Leg springs engage the hinge pin and, in conjunction with the pressure roller, provide spring mounting for the hinge arm. The leg springs are fixed in place by being clipped on to the hinge pin and function with the hinge arm as a spring clip.

5 Claims, 8 Drawing Sheets

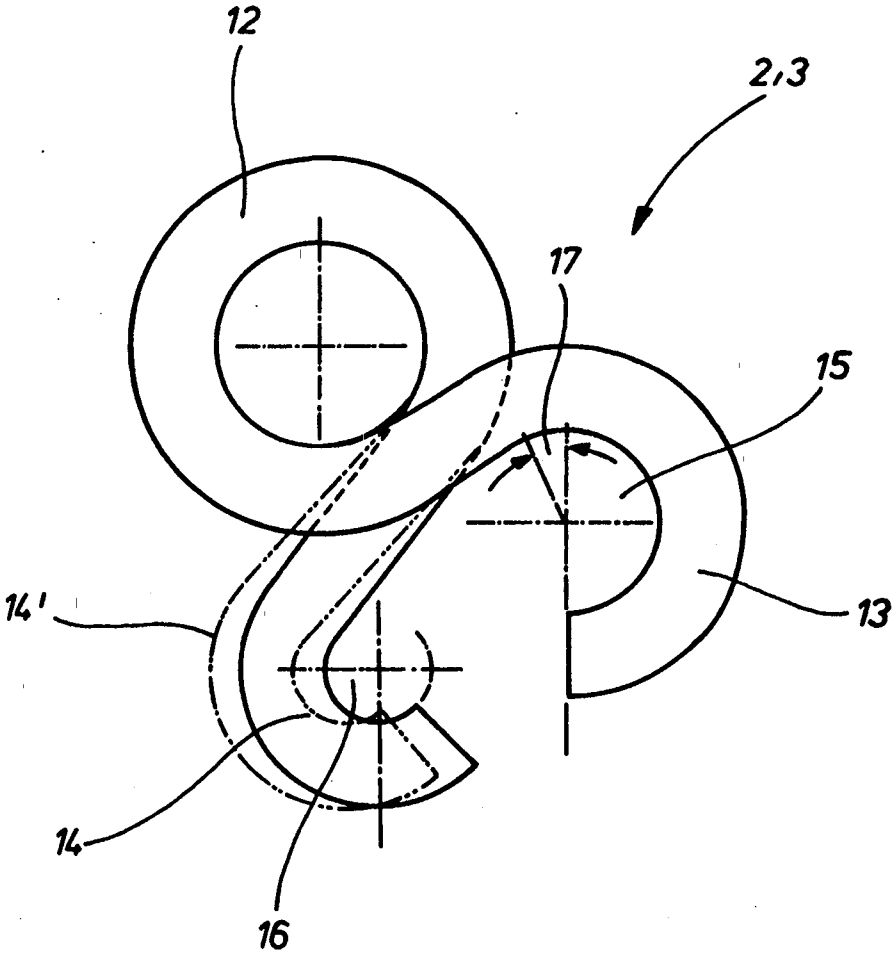
FIG 3
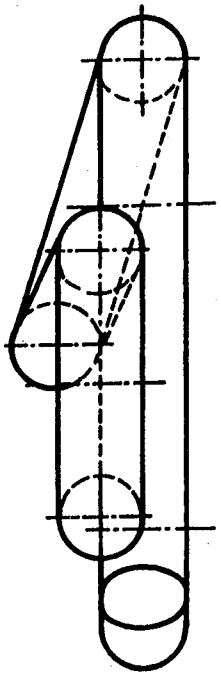

SINGLE ARTICULATION HINGE

BACKGROUND OF THE INVENTION

This application is a continuation application of my earlier file application Ser. No. 07/755,665, filed Sep. 6, 1991, now abandoned.

1. Field of the Invention

This invention relates to hinges and more particularly to a single articulation door hinge having leg springs mounted on a hinge pin in a hinge barrel.

2. Description of the Prior Art

Spring operated barrel hinges have been used for cabinets and small doors for some time. Representative of such hinges is the disclosure of U.S. patent application Ser. No. 494,632 wherein leg springs are mounted on a fixed bolt connected at one side with the wall of the barrel.

If a sheet steel housing is to be used instead of a die cast zinc housing, there are disadvantages in that it is relatively difficult to connect the fixed bolt to steel sheet walls of the hinge barrel. The rivet connection is not necessarily successful because the thin wall sheet metal can distort. Moreover, it is difficult to insert a riveting tool into the limited amount of space in the hinge barrel.

OBJECTIVES AND SUMMARY OF THE INVENTION

The purpose of the present invention is to develop a bearing or mounting for leg springs in a hinge barrel that will hold the leg springs in place in a simple way. This is accomplished by the provision of a self supporting mounting for the leg springs arranged on the left and right hand sides within the hinge barrel. For simplicity, only the leg spring of one side of the hinge barrel will be described, it being understood that the mounting on the opposite side takes precisely the same form.

In the present invention, no fixed bolt is used. Instead the hinge spring is supported by a spring clip on the pin of the hinge arm. The leg spring is clipped to the hinge with a circlip. When the spring clip is spread, the end of the spring can be easily clipped on to the round-shaped pin of the hinge arm. When the tension on the spring leg spring is released, it will then automatically clamp tightly to the pin. The leg spring has two spring ends that are opposite each other and open toward each other. They are connected to one another by one or more closed turns of the spring. The spring is thus no longer held in place by a fixed bolt but instead is clipped on the hinge pin of the moveable hinge arm as a spring clip.

In another embodiment of the present invention, the mounting of the leg springs and the barrel housing is formed by inserting the bent end of a leg spring into a hole in the inner wall of the barrel housing.

In yet another embodiment, the leg spring has a bent spring end that engages a flat metal tab bent out of the inner wall of the barrel housing.

In still another embodiment, one spring end of the leg spring engages a receiver on the side wall of the barrel housing.

In yet still another further embodiment of the present invention utilizing a spring resembling an omega, one spring end of the omega spring is clipped on the hinge pin and the other spring end engages around the pin of the pressure roller.

A feature common to all embodiments of the present invention is that the pin and pressure roller can be eliminated and that a bent spring end of a leg spring can act as a pressure component directly on the associated control face for the swiveling part of the hinge arm.

BRIEF DESCRIPTION OF THE DRAWINGS

FIG. 3 is end and side elevational view of a leg spring;

DETAILED DESCRIPTION OF THE SPECIFICATION

Figure 1:
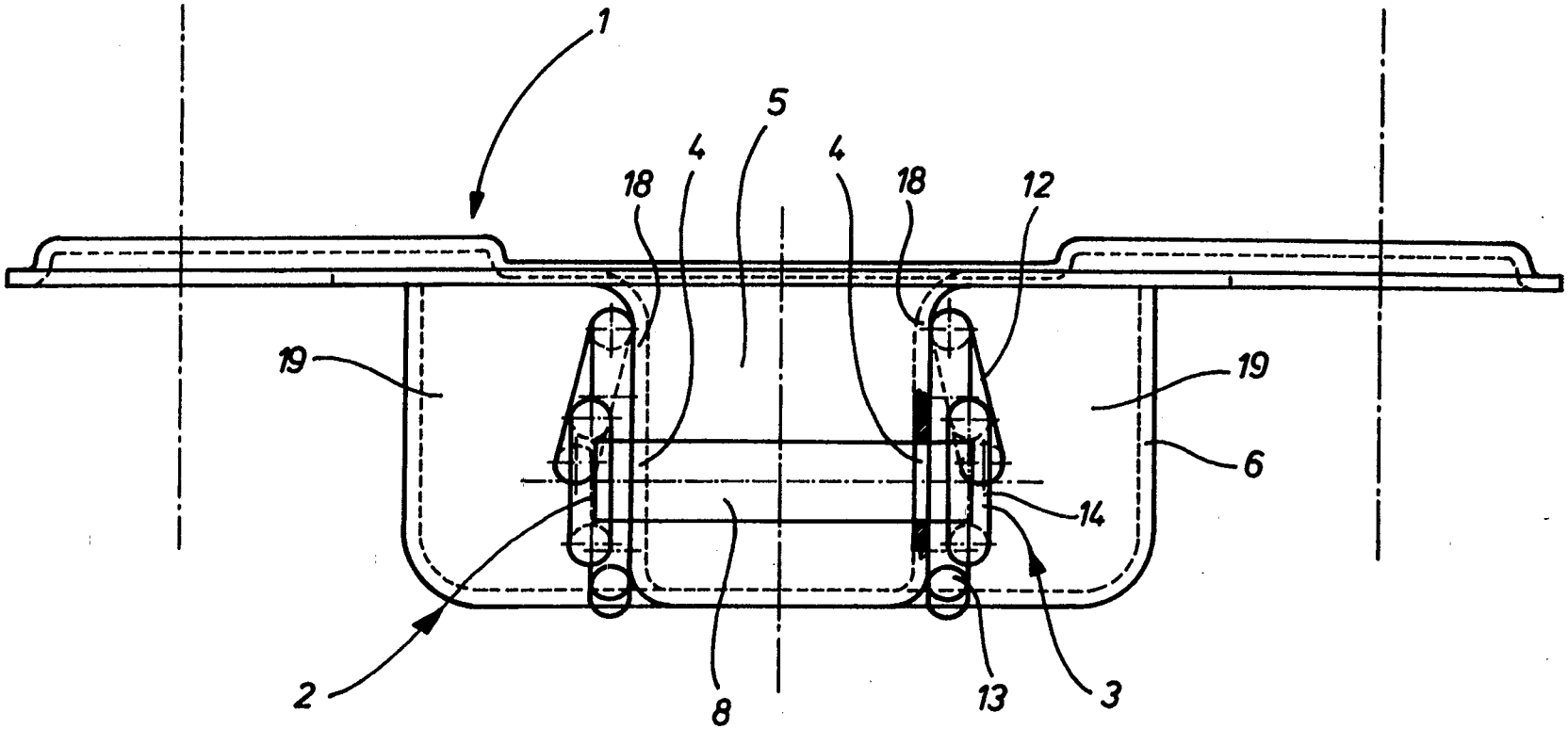
FIG. 1 is a front elevational, sectional view taken through the hinge barrel.
Figure 2:
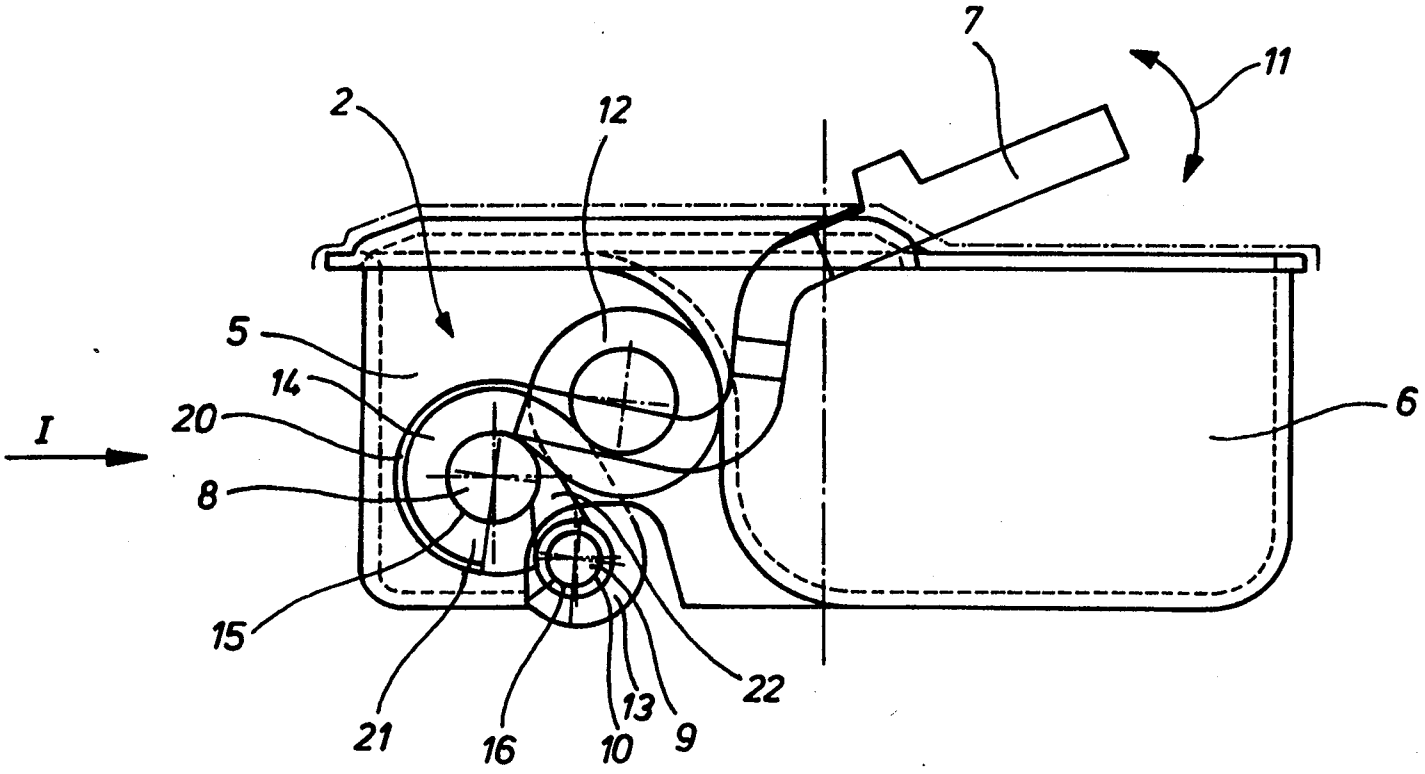
FIG. 2 is a side elevational, sectional view taken through the hinge of FIG. 1 with the hinge arm added.

Referring now to the drawings and particularly to FIG. 1, a hinge barrel shown generally as 1 consists of a barrel housing 6 having two lateral inside walls 18 which define the central interior space 5 between them. Inside walls 18 and the other walls of the hinge barrel also define chamber 19 in which leg springs 2, 3 are positioned. In alignment opposite each other, inside walls 18 are provided with recesses 4 into which a hinge pin 8 is inserted.

A hinge arm 7 swivels on hinge pin 8 in a fixed arrangement in housing 6. A closing pressure is applied through leg springs 2, 3 so that hinge arm 7 swivels downwardly in the direction of arrow 11 under spring loading into hinge barrel 1.

Figure 11:
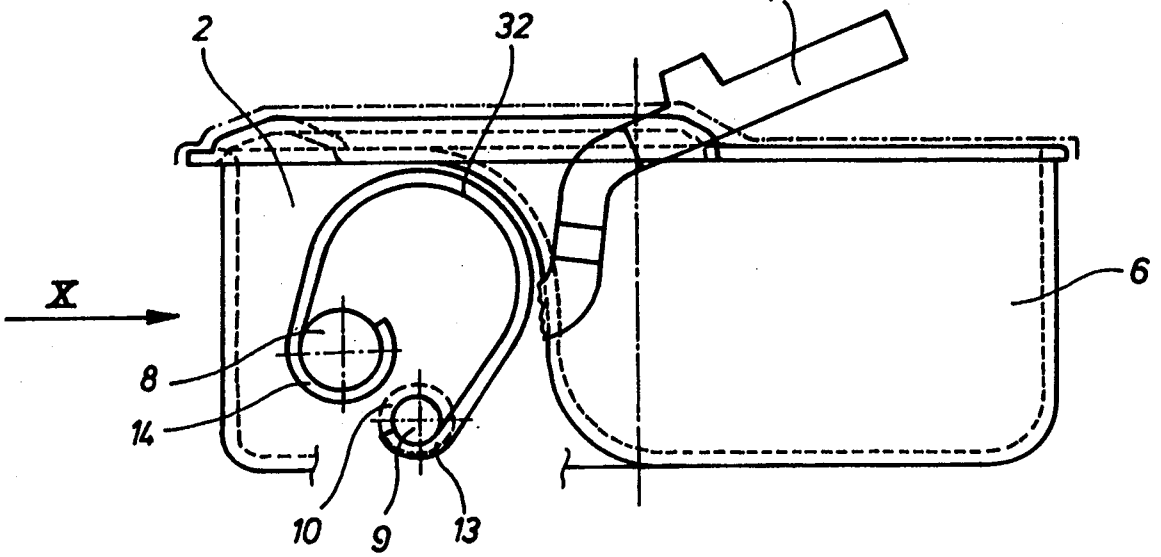
FIG. 11 is a side elevational view of the leg spring shown in FIG. 10.

As seen in FIGS. 3 and 11, leg springs 2,3 consist of coiled or omega-shaped arrangements wherein spring ends 13, 14 are formed on each of one or more closed spring turns 12. Spring ends 13, 14 are bent toward each other so that they define recesses 15, 16 opening toward each other. Recess 16 is engaged by a pin 9 which fits tightly in recess 16 where it is held in a locking engagement.

Swivelling on pin 9 is a pressure roller 10 which is pressed downwardly on the outer circumference 20 of bent end 21 of hinge arm 7. When hinge arm 7 is in the closed position, the spring pressure of the pressure roller 10 is exerted on control face 22 so that hinge arm 7 is held under spring loading in the closed position. FIG. 3 shows the spring deflection of spring end 14, 14[1] in the transition from the closed to the open position.

Leg spring 2 is mounted solely on hinge pin 8 of hinge arm 7. Hinge pin 8 fits tightly into recess 15 and is secured in that position by the tension of the spring. The outer circumference of hinge pin 8 is held beyond an angle of 180 degrees as shown by the area 17 in FIG. 3.

Angular material can be used for leg springs 2, 3 in lieu of the round material discussed previously.

Figure 4:
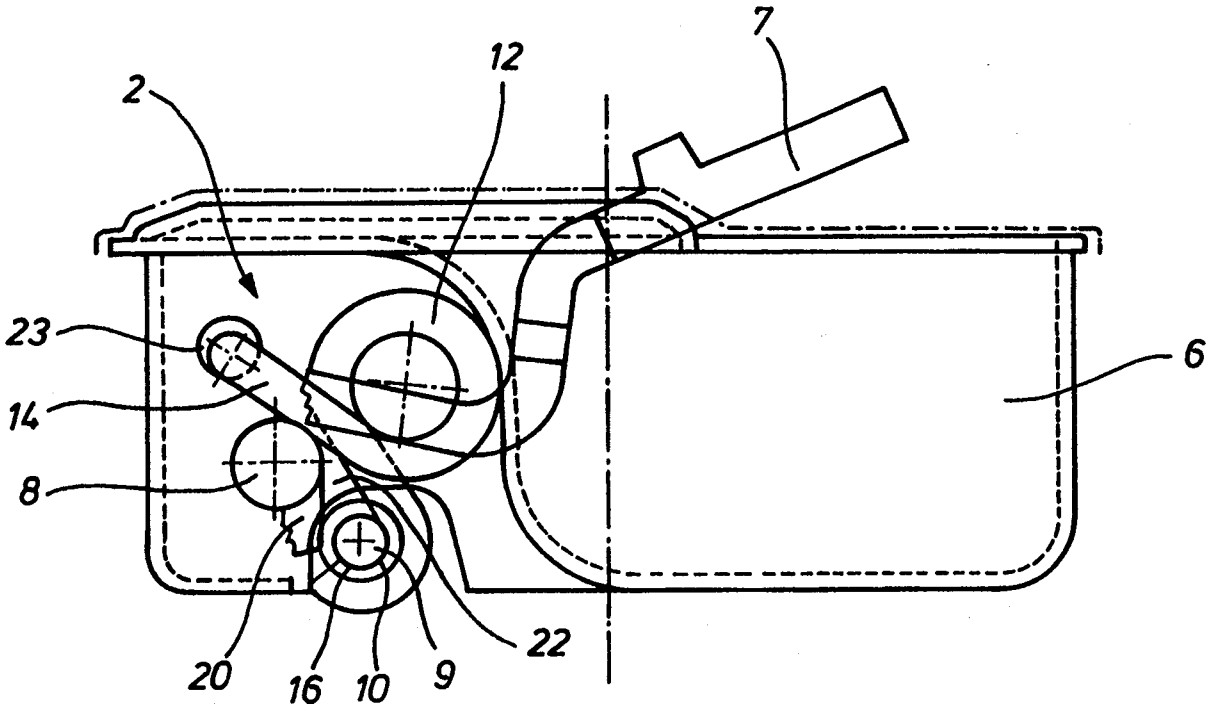
FIG. 4 is a view similar to that shown in FIG. 2 with another mounting of the leg springs.

FIG. 4 shows another mounting of leg spring 2 wherein end spring 14 is relatively straight and is bent only near one end where it engages a hole 23 in the inside wall 18 of hinge barrel 1. In this embodiment, leg spring 2 does not engage hinge pin 8.

Figure 5:
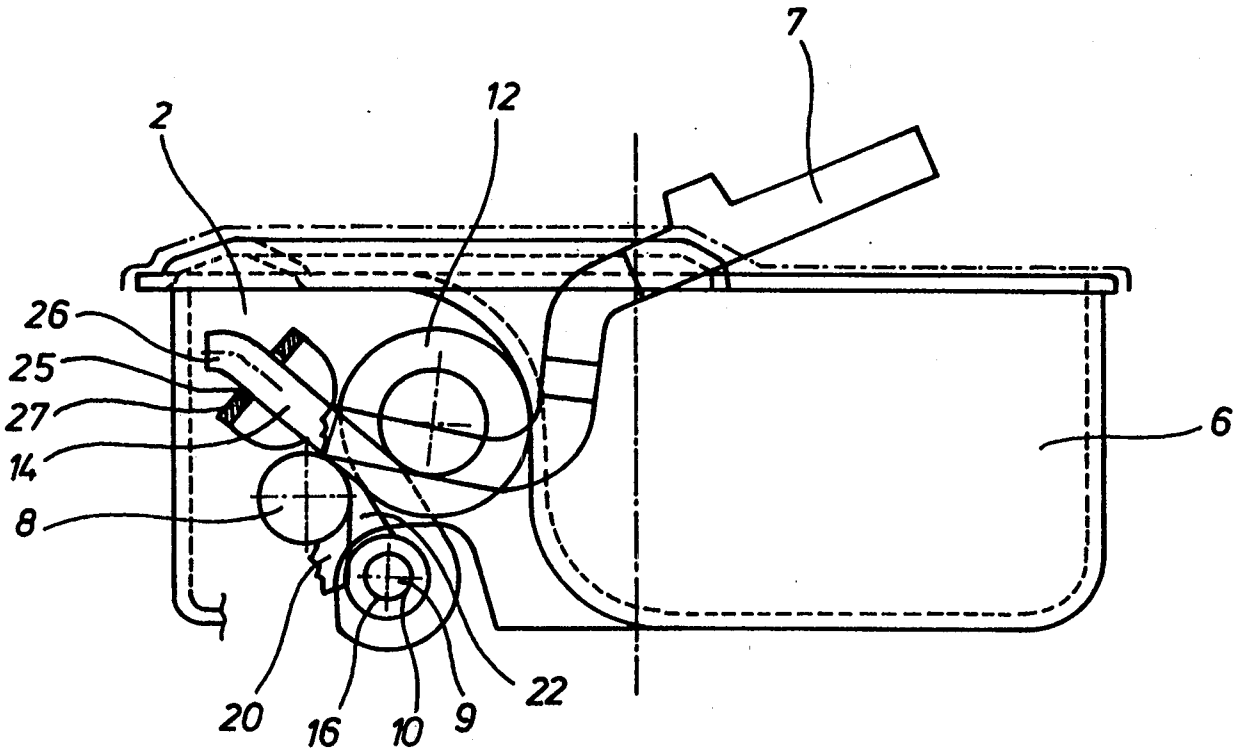
FIG. 5 is a modified view of FIG. 4.

FIG. 5 shows a variation of the spring mounting in which the spring end 14 is not introduced into a hole but rather engages an aperture 25 formed in the sheet metal tab 24 pressed from inside wall 18. In this embodiment, the outer part of spring end 14 has a bend 26 to prevent the spring from dropping free.

Figure 6:
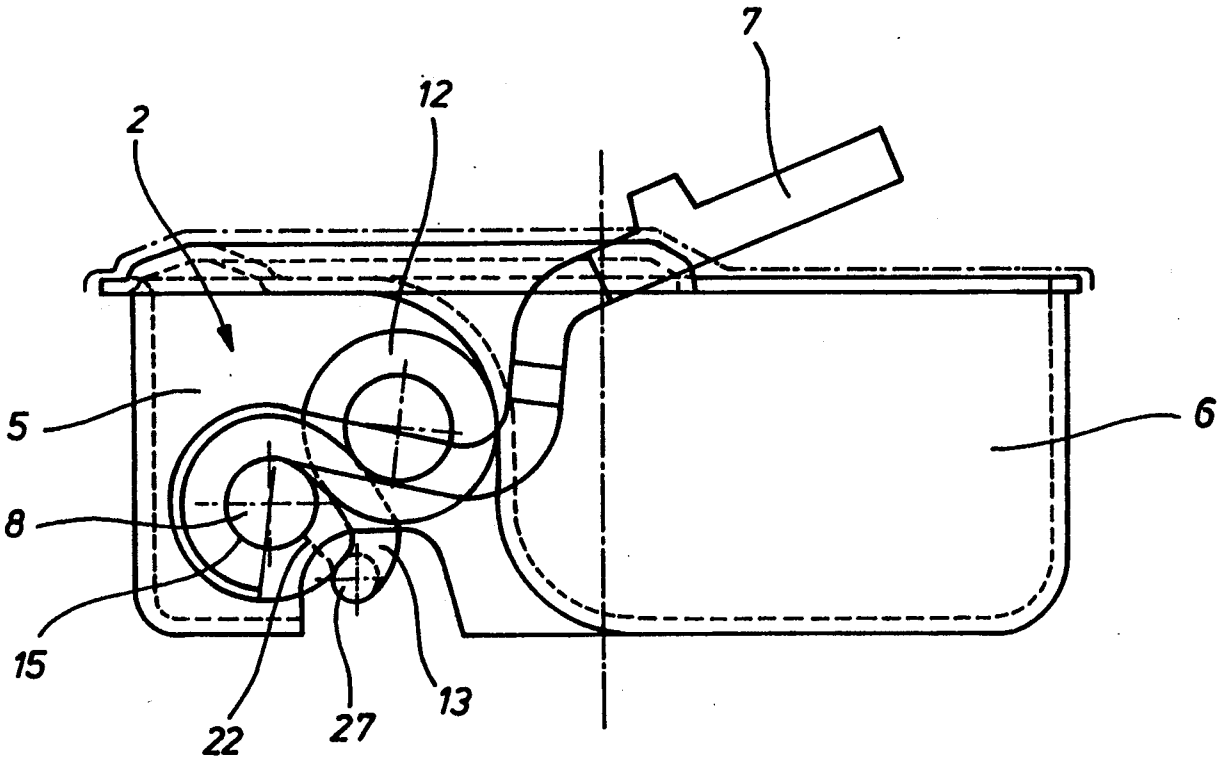
FIG. 6 is a view of another modification of FIG. 4.

FIG. 6 shows that the embodiments discussed previously and hereafter can be modified so that pin 9 and pressure roller 10 can be eliminated. This is accomplished by providing spring end 13 with another bend 27 which acts directly on the control face 22 of the pivotal part of hinge arm 7.

Figure 7:
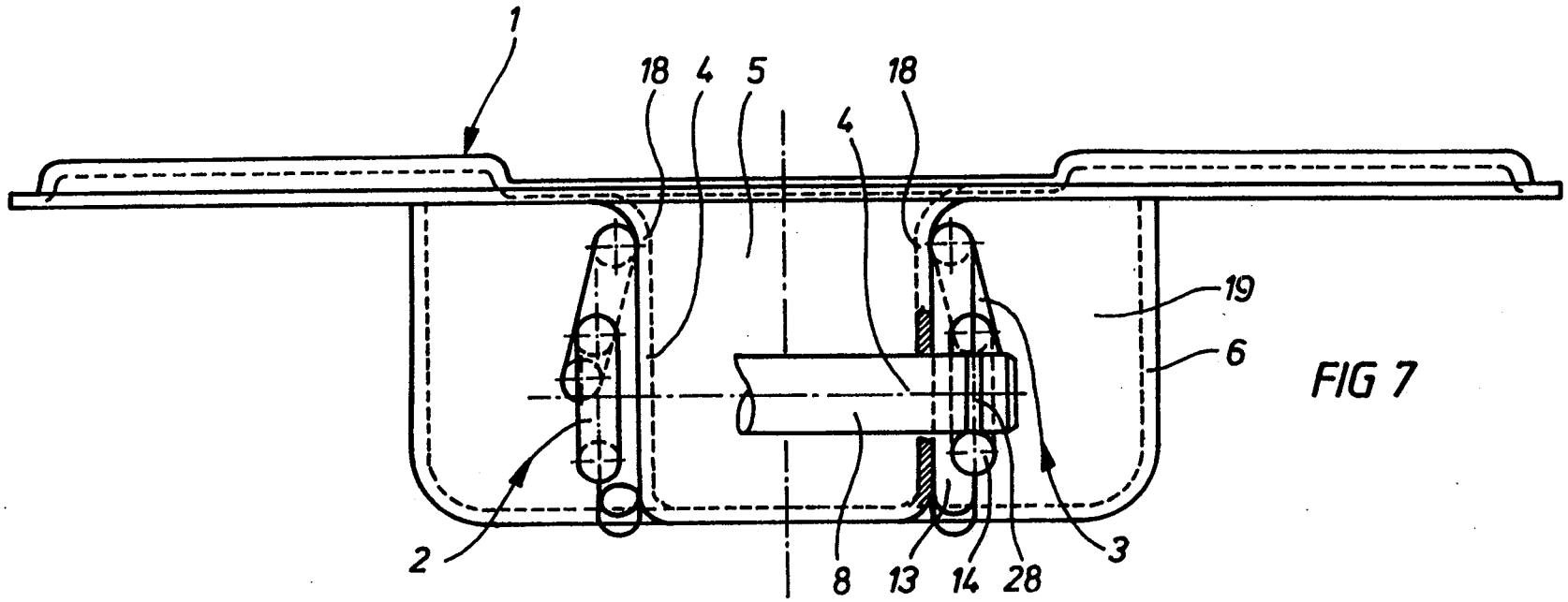
FIG. 7 is an end elevational, sectional view of another mounting for the leg spring.
Figure 8:
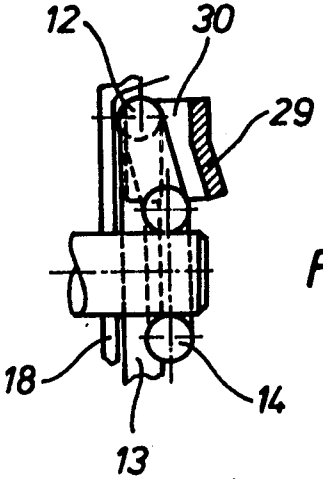
FIG. 8 is an end elevational, fragmentary, and sectional view of a variation of the spring shown in FIG. 7.

It can be seen from FIG. 7 that spring end 14 can be clipped into a groove 28 on the outer circumference of hinge pin 8 in order to provide a detachable mounting. A variation of this mounting is shown in FIG. 8 wherein spring end 14 is slid up on hinge pin 8 thereby enabling the entire spring to engage at receiver 30 which is formed by a coping bent out of the inside wall 18 of hinge barrel 1. Leg spring 2 is thereby protected from slipping from hinge pin 8.

Figure 9:
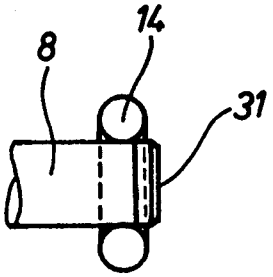
FIG. 9 is a side elevational, sectional and fragmentary view of another variation of the spring shown in FIGS. 7 and 8.

FIG. 9 illustrates another embodiment of the present invention wherein the end face of hinge pin 8 can be riveted thus providing a rivet point 31 with a diameter larger than the inside diameter of spring turn 14. This also ensures that leg springs 2, 3 remain in position on hinge pin 8.

Figure 10:
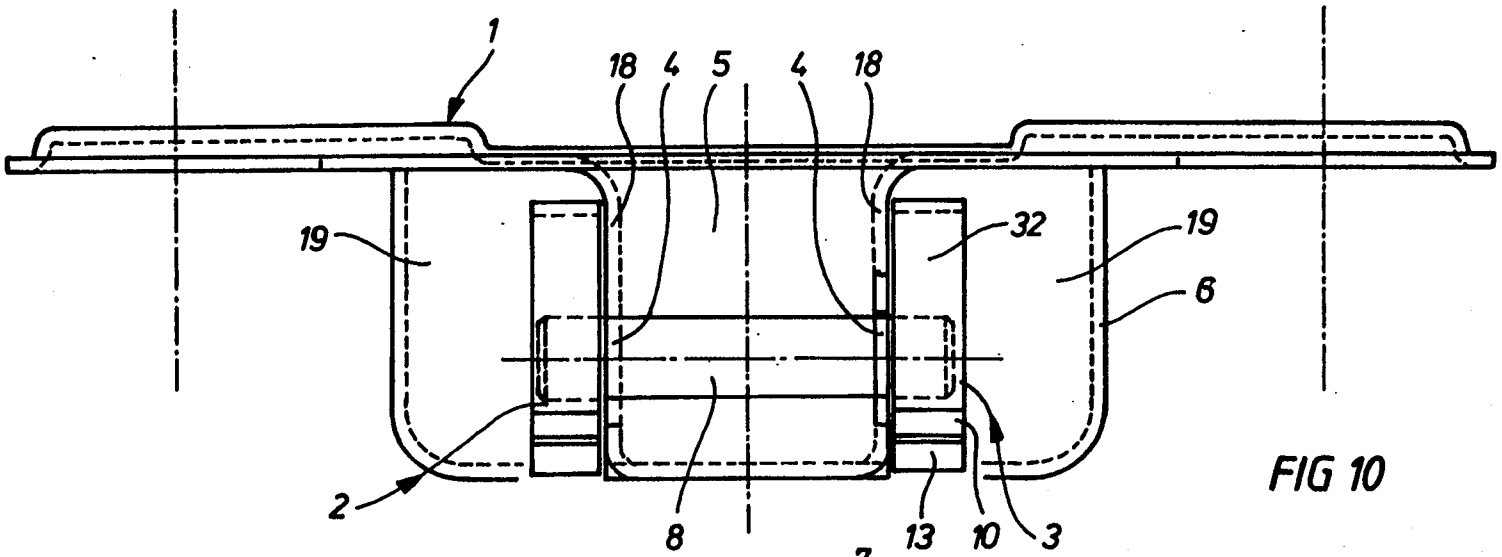
FIG. 10 is an end elevational, sectional view of another embodiment of the leg spring.

FIGS. 10 and 11 show that leg spring 2, 3 generally made of round wire can also be replaced by flat springs that have a rectangular cross-section.

Thus it can be seen that the common feature of all of the embodiments disclosed herein is that the mounting of the leg springs 2, 3 on sidewalls of the hinge barrel is simple but still produces high spring tensions and enables easy assembly.

It is to be realized that the optimum dimensional relationship to the parts of the invention, to include variations in size, materials, shape, form, function, and manner of operation, assembly and use are deemed readily apparent and obvious to one skilled in the art and all equivalent relationships to those illustrated in the drawings and described in the application are intended to be encompassed herein. The foregoing is considered as illustrative only of the principles of the invention.

Since numerous modifications and changes will readily occur to those skilled in the art, it is desired not to limit the invention to the exact construction and operation shown and described. All suitable modifications and equivalents that fall within the scope of the appended claims are deemed in the present inventive cause.

I claim:

1. A single articulation door hinge with a closing pressure device comprising: hinge barrel means having defined interior for mounting on a furniture door; a hinge pin mounted within the barrel means defined interior; a hinge arm pivotally secured to the hinge pin and movable into or out of the barrel means interior for a closed or an open position; a pressure roller movably positioned within the barrel means; and at least one leg spring having a spring body and first and second spring ends positioned within the barrel means interior, the first spring end engaging the hinge pin and the second spring end engaging the pressure roller and moveable to exert pressure on the hinge arm and urge the hinge arm into the barrel means and to the closed position wherein the first spring end is bent to at least partially encircle the hinge pin.

2. The hinge as claimed in claim 1 wherein the leg spring body is omega-shaped.

3. The hinge as claimed in claim 1 wherein the second leg spring end is bent to at least partially encircle the pressure roller.

4. The hinge as claimed in claim 3 wherein the leg spring body is omega-shaped.

5. The hinge as claimed in claim 1 wherein the leg spring is coiled.

* * * * *